US006883453B1

(12) United States Patent
Mulhern

(10) Patent No.: US 6,883,453 B1
(45) Date of Patent: Apr. 26, 2005

(54) UNMANNED WATERCRAFT RETRIEVAL SYSTEM

(75) Inventor: Francis M. Mulhern, Riverton, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/826,903

(22) Filed: Apr. 19, 2004

(51) Int. Cl.[7] ..... B63B 21/04

(52) U.S. Cl. ..... 114/253; 114/246

(58) Field of Search ..... 114/253, 254, 242, 114/246

(56) References Cited

U.S. PATENT DOCUMENTS 6,028,817 A * 2/2000 Ambs ..... 367/16
6,416,369 B1 * 7/2002 Coakley ..... 440/33

* cited by examiner

*Primary Examiner*—Stephen Avila
(74) *Attorney, Agent, or Firm*—Jacob Shuster

(57) ABSTRACT

An underwater retrieval body connected at its forward bow end by a towing line to a retrieval ship, has attachment facilities at its opposite aft end for attachment thereof during underwater propulsion with an unmanned watercraft by engaging its projecting hook or reception of a projecting probe. During propulsion of the underwater retrieval body toward the unmanned watercraft, it is maneuvered into alignment therewith through steering rudder fins under control of a homing control system on the underwater retrieval body, in response to reception of tracking signals emitted from the unmanned watercraft.

7 Claims, 5 Drawing Sheets

UNMANNED WATERCRAFT RETRIEVAL SYSTEM

STATEMENT OF GOVERNMENT INTEREST

The invention described herein may be manufactured and used by or for the Government of the United States of America for governmental purposes without the payment of any royalties thereon or therefore.

The present invention relates generally to the retrieval of watercraft.

BACKGROUND OF THE INVENTION

Current methods for retrieving unmanned waterborne vehicles such as small boats onto a retrieval ship often involve use of cranes or davits to lower some attachment device such as a hook from the retrieval ship onto the small boat to be retrieved. Under high sea state conditions, such retrieval methods become operationally difficult and inadequate because of the high winds and sea waves. In view of such retrieval difficulties, current practice often involves use of personnel to control maneuvering of the small boat to be retrieved, and manipulation of the crane suspended hook for attachment purposes. Such retrieval methods have therefore been become extremely difficult to perform and time consuming. It is therefore an important object of the present invention to provide a mostly underwater retrieval system which avoids use of the attachment lowering crane or davit and is fully automated to perform retrieval of a small boat under low to high sea state conditions.

SUMMARY OF THE INVENTION

Pursuant to the present invention, an underwater towed body connected by a towing line to a retrieval ship, is automatically maneuvered by adjustable steering rudder fins thereon under control of tracking signals emitted by a beacon from an unmanned vehicle such as a floating watercraft or submarine to be retrieved by docking thereof onto the retrieval ship. The towed body is thereby maneuvered into an aligned position relative to the unmanned vehicle for attachment thereto in order to induce its movement toward the retrieval ship for docketing thereof on the retrieval ship.

DESCRIPTION OF THE DRAWINGS

A more complete appreciation of the invention and many of its attendant advantages will be readily appreciated as the same becomes better understood by reference to the following detailed description when considered in connection with the accompanying drawing wherein.

DETAILED DESCRIPTION OF THE PREFERRED EMBODIMENT

Figure 1:
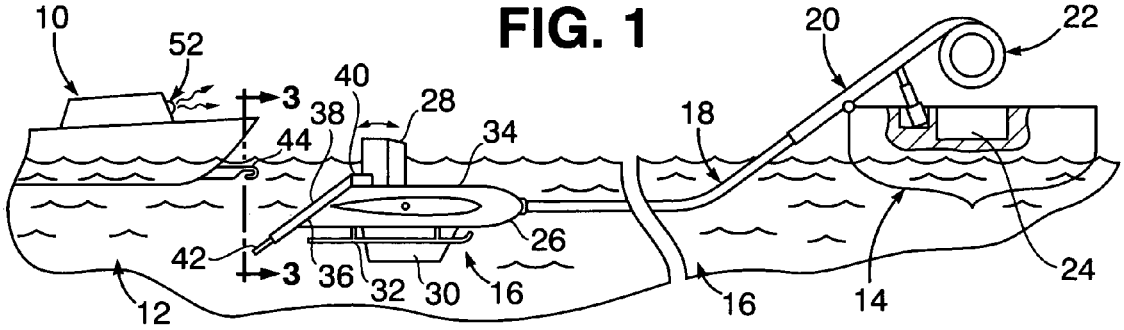
FIG. 1 is a side elevation view of an underwater retrieval body positioned between a retrieval ship and an unmanned watercraft to be retrieved.

Referring now to the drawing in detail, FIGS. 1–5 illustrate a relatively small unmanned vehicle 10 such as a watercraft floating in seawater 12 at some location from which it is to be retrieved by docking on board a seawater retrieval ship 14. Retrieval of the unmanned watercraft 10 as hereinafter explained involves use of a small size towed retrieval body 16 connected by a towing line 18 to the retrieval ship 14. The unmanned watercraft 10 may be powered and refueled from some external source as generally known in the art before being engaged by the towed body 16 for retrieval by docketing onto the ship 14.

Figure 4:
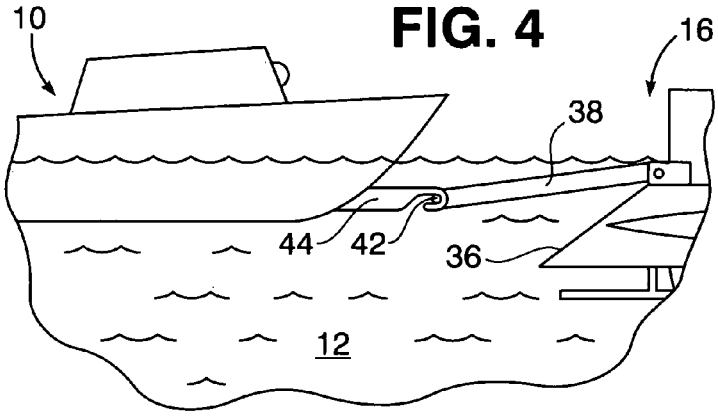
FIG. 4 is a partial side elevation view showing the unmanned watercraft hooked to the underwater retrieval body during a retrieval process.
Figure 5:
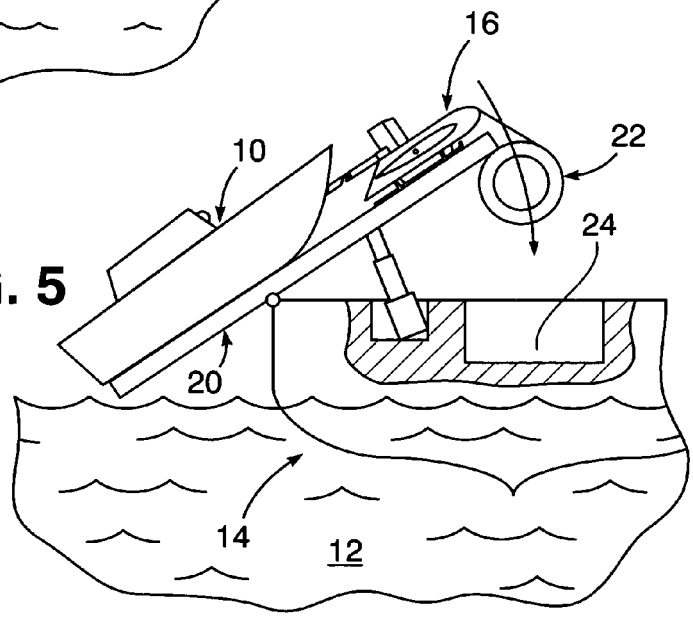
FIG. 5 is a partial side elevation view showing docking of the unmanned watercraft onto the retrieval ship.

In FIG. 1, the unmanned watercraft 10 is shown located adjacent to but disengaged from the retrieval body 16 at the beginning of a retrieval process. In FIG. 4, the unmanned watercraft 10 is shown engaged by the retrieval body 16 so as to be towed thereby through the towing line 18 toward the retrieval ship 14 shown in FIGS. 1 and 5 with a docking platform 20 pivotally mounted thereon, from which the towing line 18 is extended and through which it is reeled into a cable storage roll 22. When the unmanned watercraft 10 is attached to the retrieval body 16 as shown in FIG. 4, it may be towed therewith toward the retrieval ship 14 during reel in of the towing line 18 in order to accommodate reception thereof onto the pivotally inclined docking platform 20 as shown in FIG. 5. The docking platform 20 may then be pivotally displaced to its retracted horizontal position with the towing line storage roll 22 received in a receptacle 24 for docking retention of the watercraft 10 onboard the retrieval ship 14.

Referring now to FIGS. 1, 2, 3 and 4, the retrieval body 16 according to one embodiment has a forward convergent bow end 26 to which the towing line 18 is connected. A pair of angularly adjustable control surface rudder fins 28 extend vertically upward from the top of the body 16, while a rudder fin 30 is fixed to the bottom of the body 16 between elongated legs 32 also fixed thereto. Angularly adjustable side fins 34 extend laterally from the sides of the towed body 16. The rudder fins 28 and 34 are angularly adjusted under automated control so as to maneuver the body 16 while attached to the towing line 18 relative to the unmanned watercraft 10 as shown in FIG. 1, for attachment thereto by hooked engagement therewith as shown in FIG. 4.

Figure 2:
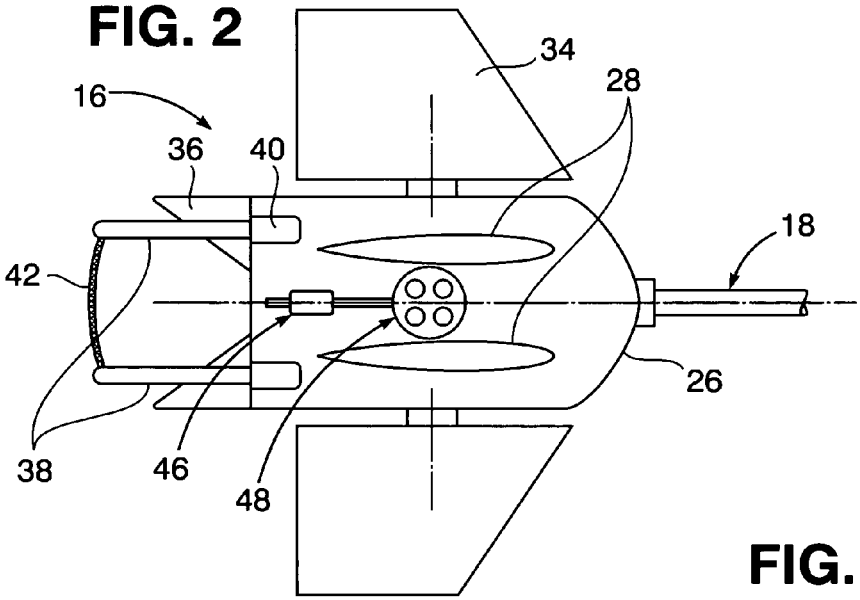
FIG. 2 is a top plan view of the underwater retrieval body shown in FIG. 1.
Figure 3:
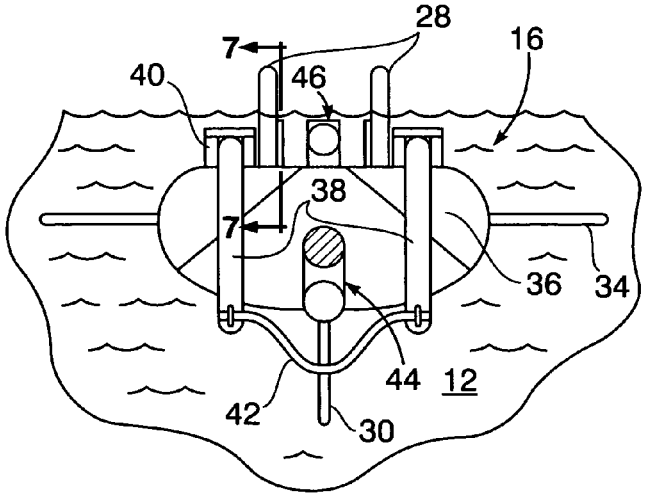
FIG. 3 is an end view of the underwater retrieval body as viewed from section line 3—3 in FIG. 1.

Aft end portions 36 on the retrieval body 16 are downwardly inclined as shown in FIGS. 1–3 for support of a pair of poles 38 in lowered positions, pivotally connected at their upper ends to the body 16 by pivot anchors 40. The lower ends of the poles 38 suspend therefrom a wire loop 42 so as to be positioned in underlying relation to a hook 44 projecting from the unmanned watercraft 10 in its aligned position adjacent to the body 16 as shown in FIGS. 1 and 3. Thus, the poles 38 when raised from their lowered position as shown in FIG. 4 engage the wire loop 42 with the hook 44 so as to attach the watercraft 10 to the body 16 for towing to and retrieval docking on the ship 14.

Figure 6:
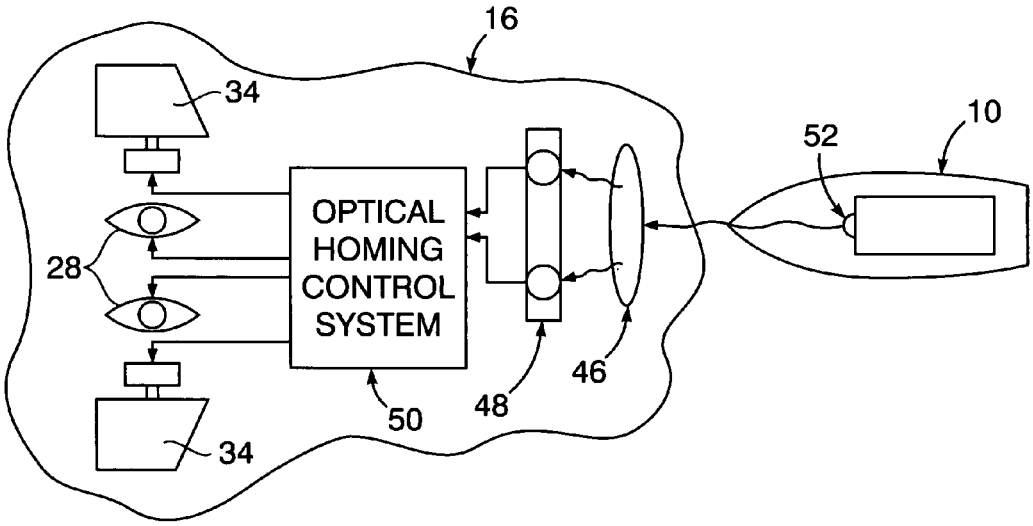
FIG. 6 is a diagram of automated maneuvering controls associated with the underwater retrieval body.
Figure 7:
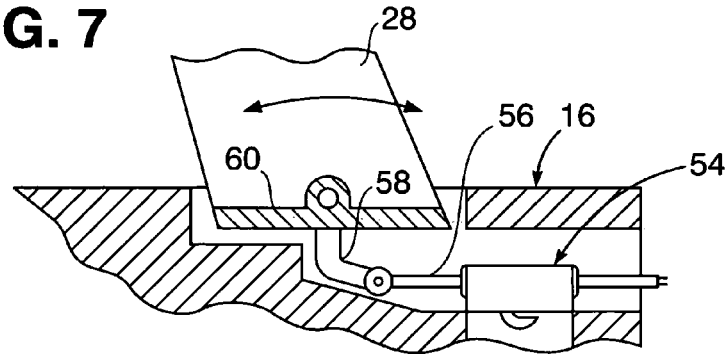
FIG. 7 is a partial section view taken substantially through a plan indicated by section line 7—7 in FIG. 3.
Figure 8:
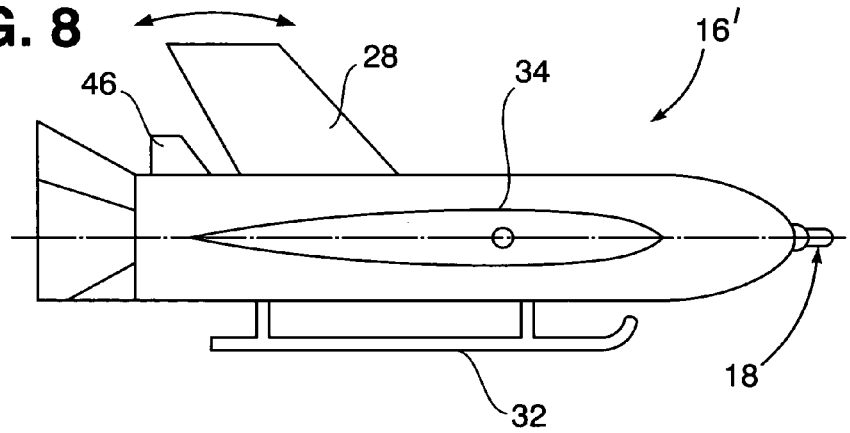
FIG. 8 is a side elevation view of an underwater retrieval body in accordance with another embodiment.
Figure 9:
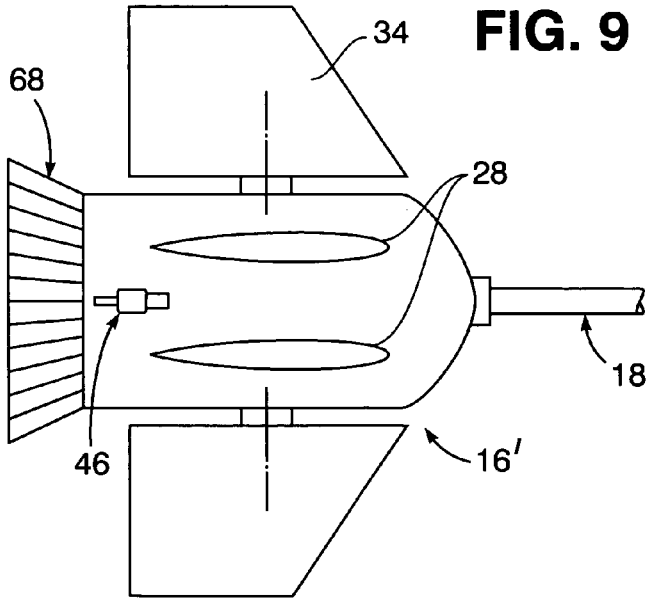
FIG. 9 is a top plan view of the underwater retrieval body shown in FIG. 8.
Figure 10:
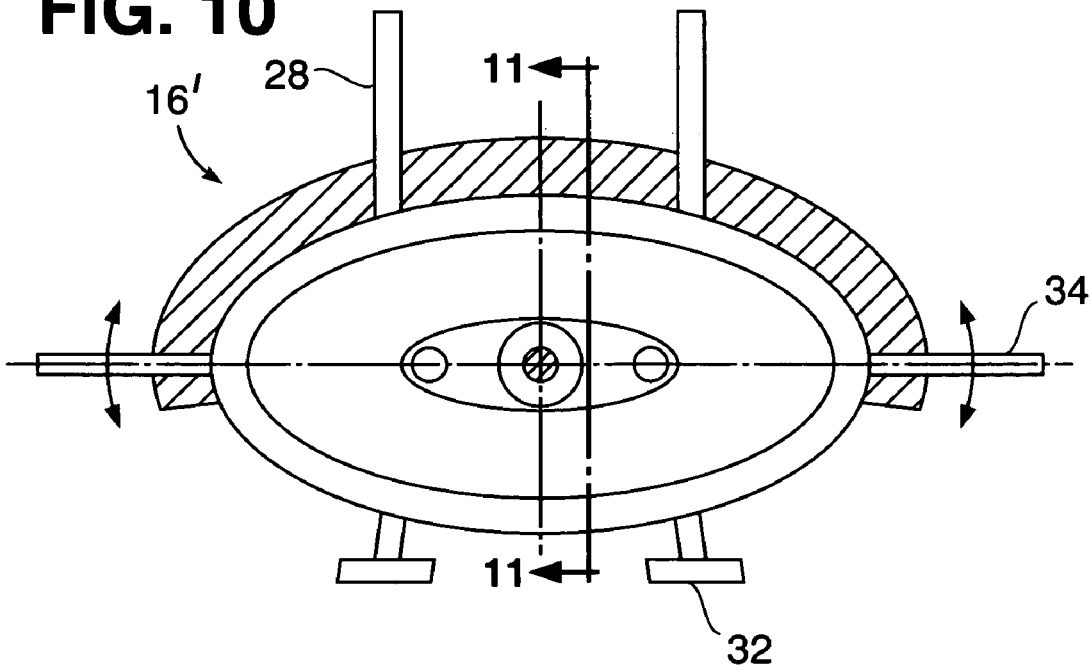
FIG. 10 is an end view of the underwater retrieval body shown in FIGS. 8 and 9.
Figure 11:
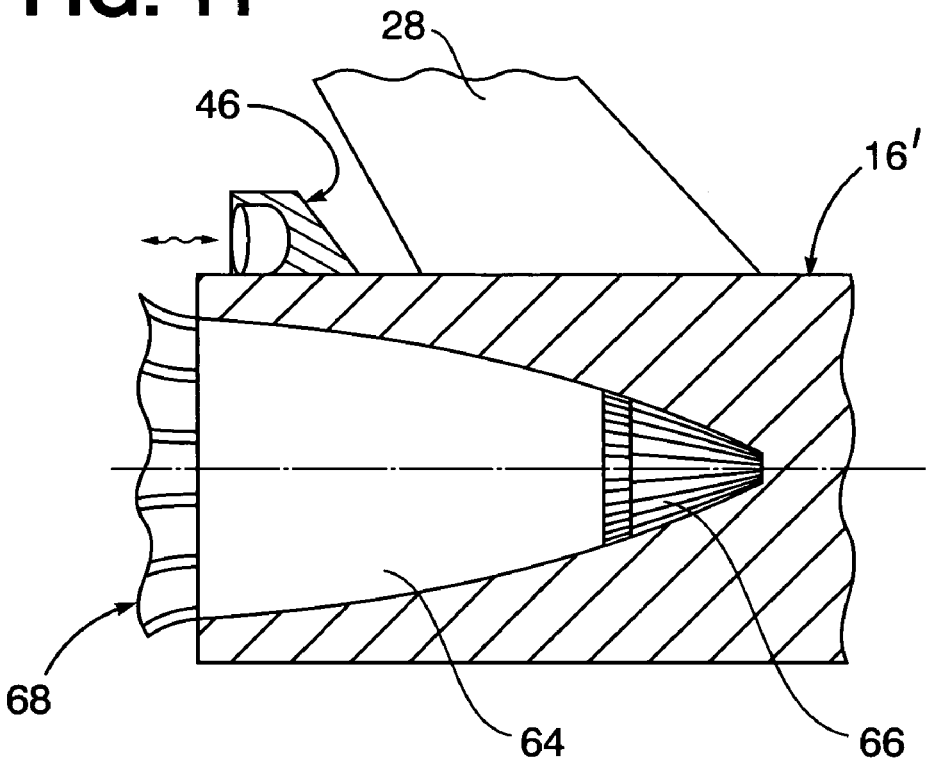
FIG. 11 is a partial section view taken substantially through a plane indicated by section line 11—11 in FIG. 10.

Also positioned on top of the retrieval body 16 at its aft end between the pole pivot anchors 40 is a guidance lens scanner 46 connected to a photocell maneuvering array 48, also positioned on the towed body 16 as shown in FIG. 2 and diagrammed in FIG. 6, for maneuvering the body 16 (by the adjustable rudder fins 28 and 34 as aforementioned) under automatic control of an optical homing control system 50. Inputs to the homing control system 50 are received from the photocell array 48 in response to tracking light signals from the guidance lens scanner 46. Such light signals are generated by an optical beacon 52 on the unmanned watercraft 10. Steering command outputs of the maneuvering control system 50 in response to the tracking light signals are accordingly applied through steering actuators associated with the rudder fins 28 and 34. Each of the steering actuators as diagrammed in FIG. 6 may embody an electrically controlled actuator device 54 for angular steering adjustment of the rudder fin 28 for example as shown in FIG. 7. The steering adjustment actuator device 54 connected to the homing control system 50 has an adjustment rod 56 extending therefrom for pivotal connection through a bell crank 58 to a pivot bearing hinge 60 on the rudder fin 28.

Figure 12:
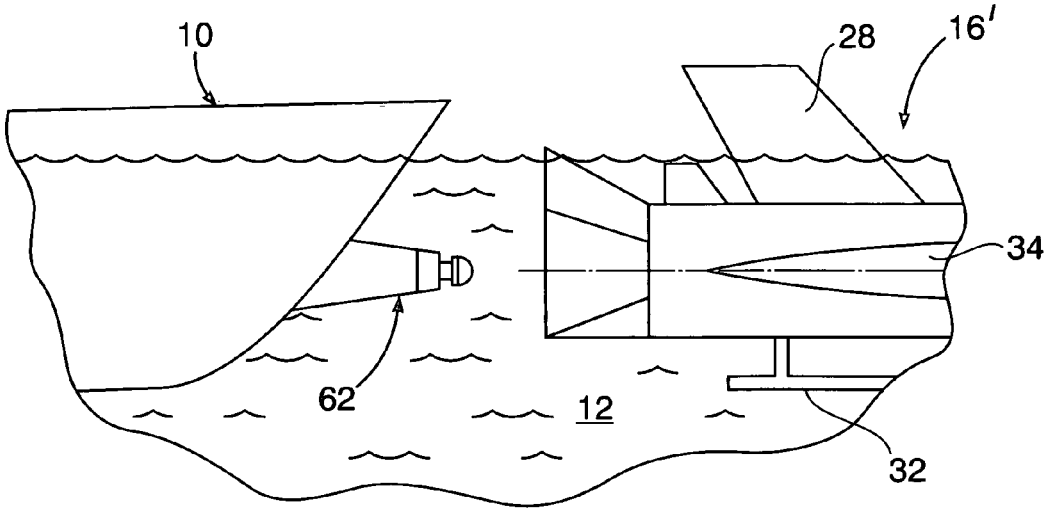
FIG. 12 is a partial side elevation view of the underwater retrieval body illustrated in FIGS. 8–11, positioned adjacent to an unmanned watercraft to be retrieved.
Figure 13:
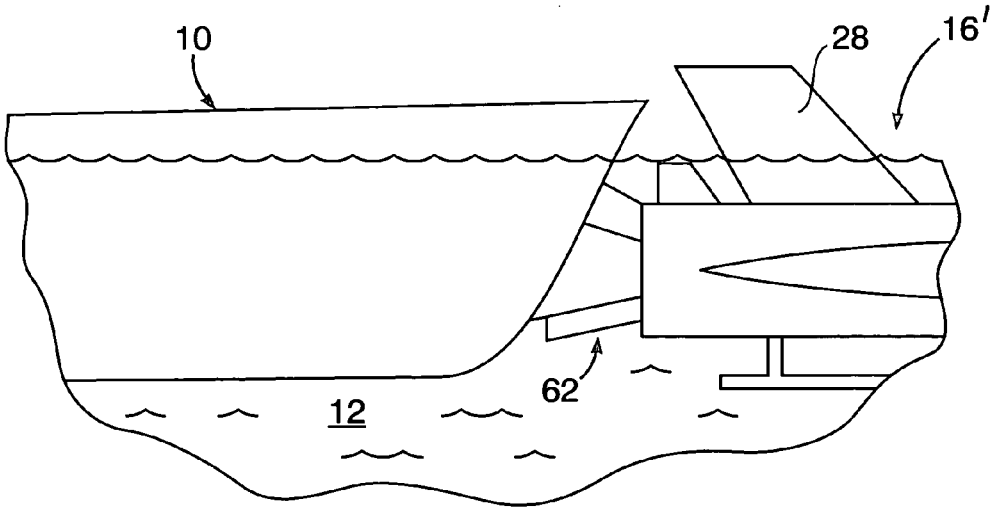
FIG. 13 is a partial side elevation view of attachment of the watercraft shown in FIG. 12 attached to the underwater retrieval body shown in FIG. 8 during retrieval movement toward a retrieval ship.

FIGS. 8–13 illustrate retrieval of the unmanned watercraft 10 by use of a modified form of retrieval body 16' in accordance with another embodiment of the present invention, generally similar to that previously described body 16 except for the manner in which the watercraft 10 is engaged therewith at its rear aft end. Instead of the attachment hook 44 as hereinbefore described, a conical docking probe 62 extends forwardly from the helm of the watercraft 10 as shown in FIG. 12, adapted to be received within the aft end of the body 16' as shown in FIG. 13. The aft end portion of the body 16' is therefore internally provided with a conical guide funnel 64 terminated by a mating socket 66 within which the end portion of the probe 62 is received to establish attachment as well as to provide fueling and electrical connections between the watercraft 10 and the body 16'. A wire netting cage 68 is also anchored to the aft end of the body 16', extending from the funnel 64 for guided reception of the probe 62. Thus modification associated with the body 16' resides in the provision of the guide funnel 64 and the probe socket 66 therein, together with the wire cage 68 for attachment purposes and for fuel and electrical power transmission to the unmanned watercraft 10.

The foregoing watercraft retrieval process involving use of the retrieval body 16 or 16' may be applied to a submarine type watercraft as in the case of the surface floating watercraft 10 described. Additionally, other modifications and variations of the present invention may be possible in light of the foregoing teachings. It is therefore to be understood that within the scope of the appended claims the invention may be practiced otherwise than as specifically described.

What is claimed is:

1. In combination with an unmanned watercraft and a retrieval ship, retrieval means for docking the unmanned watercraft onto the retrieval ship, comprising: an underwater propelled body; a tow line connecting said body to the retrieval ship; adjustable rudder means mounted on the underwater body for maneuvering thereof into alignment with the watercraft; and attachment means for attaching the unmanned watercraft to the underwater body in alignment therewith to enable said docking of the unmanned watercraft on the ship.

2. The combination as defined in claim 1, wherein said attachment means comprises: a hook projecting from the unmanned watercraft; and hook engaging means pivotally mounted on the underwater body for drag of the watercraft toward the retrieval ship by the tow line.

3. The combination as defined in claim 2, wherein the retrieval ship is provided with docking platform means pivotally mounted thereon for displacement to an inclined position at which the watercraft is positioned thereon by reel in of the tow line.

4. The combination as defined in claim 3, including homing control means mounted on the underwater body for controlling said maneuvering thereof into said alignment with the unmanned watercraft in response to tracking signals emitted therefrom.

5. The combination as defined in claim 1, wherein the retrieval ship is provided with docking platform means pivotally mounted thereon for displacement to an inclined position at which the watercraft is positioned thereon by reel in of the tow line.

6. The combination ad defined in claim 1, including homing control means mounted on the underwater body for controlling said maneuvering thereof into said alignment thereof with the unmanned watercraft in response to tracking signals emitted therefrom.

7. The combination as defined in claim 1, wherein said attachment means includes: a docking probe projecting from the unmanned watercraft; and socket funnel means formed with the underwater body for reception of the docking probe therein.

* * * * *